US009736892B2

(12) United States Patent
Yamauchi

(10) Patent No.: US 9,736,892 B2
(45) Date of Patent: Aug. 15, 2017

(54) HIGH-FREQUENCY HEATING COOKER

(75) Inventor: Masato Yamauchi, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 648 days.

(21) Appl. No.: 14/111,995

(22) PCT Filed: Apr. 19, 2012

(86) PCT No.: PCT/JP2012/002729

§ 371 (c)(1),
(2), (4) Date: Oct. 15, 2013

(87) PCT Pub. No.: WO2012/144223

PCT Pub. Date: Oct. 26, 2012

(65) Prior Publication Data

US 2014/0027448 A1 Jan. 30, 2014

(30) Foreign Application Priority Data

Apr. 20, 2011 (JP) ..... 2011-093741

(51) Int. Cl.
*H05B 6/78* (2006.01)
*H05B 6/64* (2006.01)

(52) U.S. Cl.
CPC ..... *H05B 6/782* (2013.01); *H05B 6/6411* (2013.01)

(58) Field of Classification Search
CPC ..... H05B 6/782; H05B 6/6411; H05B 6/06
USPC ..... 219/518, 754, 762, 738, 751, 745, 756, 219/708; 99/325, 328; 177/245, 29, 177/210 FP
See application file for complete search history.

(56) References Cited

U.S. PATENT DOCUMENTS 4,036,151 A * 7/1977 Shin ..... H05B 6/6411 108/136
5,166,486 A * 11/1992 Komatsu ..... H05B 6/6411 219/754
6,127,665 A 10/2000 Tatsumu

FOREIGN PATENT DOCUMENTS

JP 60-181897 U 12/1985
JP 62-020496 U 2/1987
JP 02-066866 A 3/1990
JP 11-111448 A 4/1999
(Continued)

OTHER PUBLICATIONS

International Search Report for International Application No. PCT/JP2012/002729, dated Jun. 12, 2012, 2 pages.

*Primary Examiner* — Quang Van
(74) *Attorney, Agent, or Firm* — Brinks Gilson & Lione

(57) ABSTRACT

A high-frequency heating cooker includes: a heating chamber; a high-frequency heating unit; a tray table; a tray table rotating shaft which includes a cylindrical shaft portion and which holds the tray table; and an electric motor which rotates the tray table. The electric motor is fixed to the heating chamber by an electric motor mounting plate, and is configured to transmit a force of an electric motor rotating shaft to the tray table rotating shaft. The tray table rotating shaft transmits a rotating force to the tray table, and is made of a resin molding material. The tray table rotating shaft includes a tray table rotating shaft protrusion formed on a side surface of the cylindrical shaft portion, thereby being configured not to be easily removed from interior of the heating chamber.

2 Claims, 4 Drawing Sheets

(56) References Cited

FOREIGN PATENT DOCUMENTS

JP 2003-142251 A 5/2003

* cited by examiner

HIGH-FREQUENCY HEATING COOKER

This application is a 371 application of PCT/JP2012/002729 having an international filing date of Apr. 19, 2012, which claims priority to JP 2011-093741 filed Apr. 20, 2011, the entire contents of which are incorporated herein by reference.

TECHNICAL FIELD

The present invention relates to a high-frequency heating cooker.

BACKGROUND ART

In a related-art high-frequency heating cooker, for example, a food as an object to be heated is placed on a tray table serving as a food placing table, and means for rotating the tray table is provided to realize uniform cooking through microwaves (high-frequency waves). FIG. 4 illustrates a related-art tray table rotating shaft disclosed in Patent Document 1. As illustrated in FIG. 4, a tray table rotating shaft 1, a tray table 2, and an electric motor 3 are disposed within a heating chamber 4.

RELATED ART DOCUMENTS

Patent Documents

Patent Document 1: JP-A-2003-142251

SUMMARY OF THE INVENTION

Problem to be Solved by the Invention

In the above related-art configuration, the tray table rotating shaft 1 can be easily removed by a user. Therefore, there arise such problems that when the heating chamber is cleaned, the tray table rotating shaft 1 is removed and may be damaged or lost, or a wiping water may enter a hole provided for the removed tray table rotating shaft 1 and intrude the electric motor 3 located below the tray table rotating shaft 1 (refer to FIG. 4), which may result in earth fault or electric shock.

The present invention has been made to solve the above problems with the related art, and an object thereof is to provide a high-frequency heating cooker which can prevent the electric shock with a simple configuration, and is safe and efficient.

Means for Solving the Problem

In order to solve the above problems with the related art, the present invention realizes a high-frequency heating cooker which is configured to prevent a tray table rotating shaft from being easily removed by a user, which prevents water from entering the tray table rotating shaft, and which is simple in configuration, safe, and efficient.

With the above configuration, the tray table rotating shaft is formed integrally with the heating chamber, whereby water can hardly enters a hole provided in the center of the heating chamber.

Also, in the high-frequency heating cooker according to the present invention, a fitting portion of a tray table rotating shaft leading end to an electric motor rotating shaft is located inside of a leading end portion of the tray table rotating shaft, extends above a flange portion of an electric motor mounting plate for engagement. With this configuration, water that enters a slight gap formed between the tray table rotating shaft and a heating chamber hole travels on a side surface of the cylindrical tray table rotating shaft, and drops outside of the flange portion of the electric motor mounting plate. As a result, the water can be prevented from traveling on the electric motor rotating shaft to enter an electrically conductive portion within the electric motor.

Advantages of the Invention

The tray table rotating shaft structure of the high-frequency heating cooker according to the present invention enables the efficient rotation of the tray table with a simple configuration, prevents water or a cooking oil from the heating chamber from entering an electric portion, and is excellent in cooking performance and safe.

MODE FOR CARRYING OUT THE INVENTION

Figure 1:
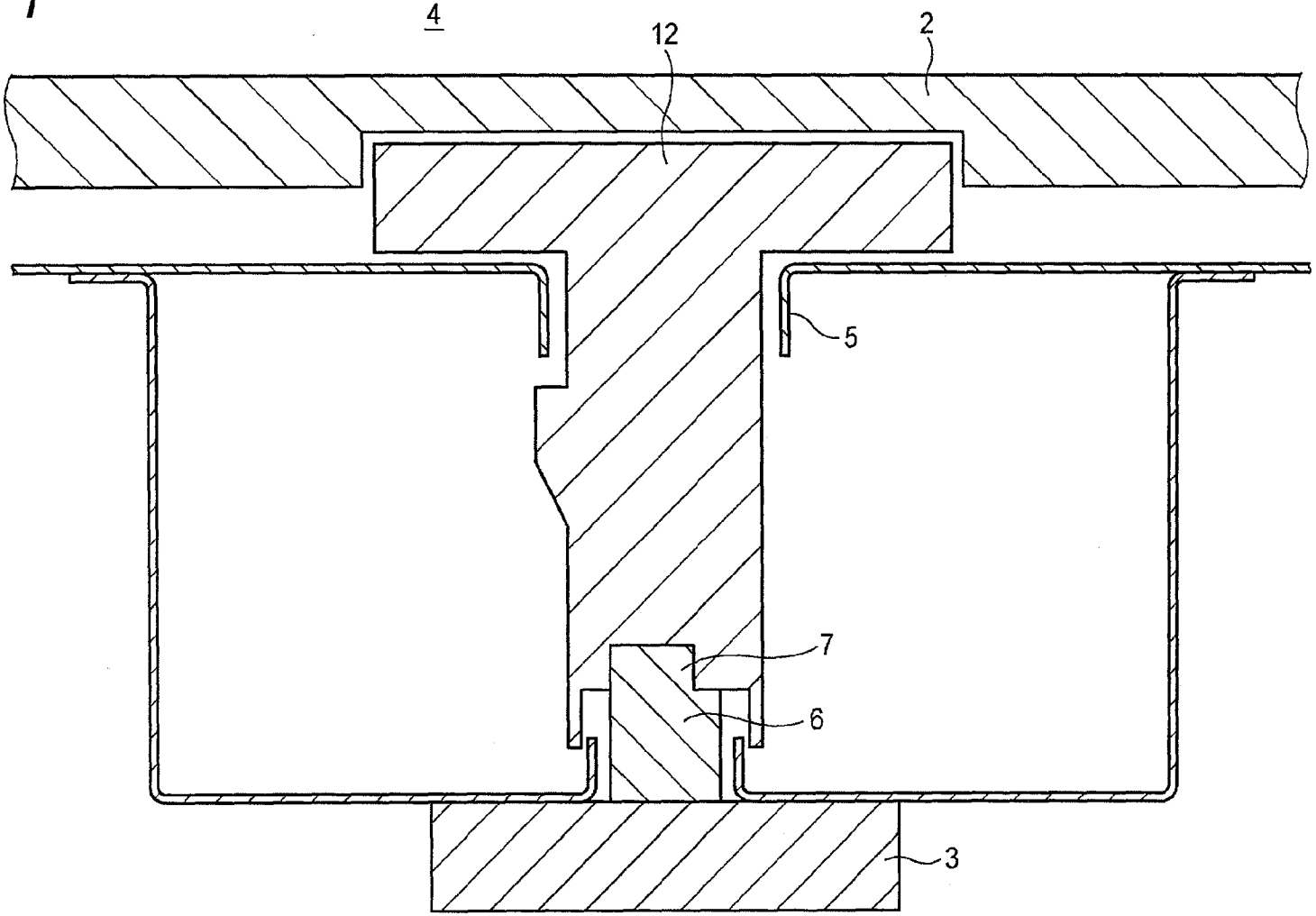
FIG. 1 is a cross-sectional view of a tray table rotating shaft structure of a high-frequency heating cooker according to a first embodiment of the present invention.

According to a first aspect of the present invention, there is provided a high-frequency heating cooker including: a heating chamber which cooks an object to be cooked; high-frequency heating means for supplying microwaves to the heating chamber; a tray table which rotates with the object to be cooked placed thereon within the heating chamber; and an electric motor which rotates the tray table, wherein the electric motor is fixed to the heating chamber by an electric motor mounting plate, and is configured to transmit a force of an electric motor rotating shaft arranged in the electric motor to the tray table rotating shaft, and wherein the tray table rotating shaft transmits a rotating force to the tray table to rotate the object to be cooked, the tray table rotating shaft is made of a resin molding material, the tray table rotating shaft includes a tray table rotating shaft protrusion formed on a part of a side surface of the cylindrical shaft, thereby being configured not to be easily removed from interior of the heating chamber.

According to the first aspect of the present invention, by forming a protrusion structure on a part of the side surface of the cylindrical tray table rotating shaft to have a tapered or rounded shape on an inserting direction, when the tray table rotating shaft is inserted into a hole located in the center of the heating chamber, the tray table rotating shaft can be fitted into the hole in a tightly fitting state.

According to a second aspect of the present invention, in the first aspect, after the tray table rotating shaft is fitted to the heating chamber, the tray table rotating shaft protrusion is located below a flange portion of the heating chamber center hole portion, thereby being configured not to be easily removed from the interior of the heating chamber. Further, the tray table rotating shaft is combined with the electric motor rotating shaft by a protrusion-recess configuration in order to efficiently receive the rotating force of the electric motor rotating shaft, thereby being configured not to be pulled out with an angle in the heating chamber direction by the protrusion-recess configuration with the electric motor rotating shaft after the electric motor is fitted.

According to the second aspect of the present invention, in particular, the cylindrical leading end portion of the tray table rotating shaft according to the first aspect of the present invention is fitted to the electric motor shaft in the protrusion-recess configuration, thereby being capable of efficiently transmitting the rotating force of the electric motor to the rotation of the tray table.

In a fitting portion of the tray table rotating shaft leading end to the electric motor rotating shaft, a flange is provided on the electric motor mounting plate to extend upward, and the flange portion of the electric motor mounting plate is located inside of a leading end portion of the tray table rotating shaft, and extends above the flange portion of the electric motor mounting plate for engagement.

According to a third aspect of the present invention, in particular, the cylindrical leading end portion of the tray table rotating shaft according to the first or second aspect of the present invention is fitted to the electric motor shaft in the protrusion-recess configuration. With this configuration, the tray table rotating shaft is combined with the electric motor rotating shaft while the tray table rotating shaft is fitted to the heating chamber so that no failure occurs in lateral and longitudinal directions at the time of rotating the tray table rotating shaft.

According to a fourth aspect of the present invention, the cylindrical leading end portion of the tray table rotating shaft according to any one of the first to third aspects of the present invention is provided with a flange, and the flange is extended below and arranged outside a flange of the electric motor mounting plate disposed in the hole portion through which the electric motor shaft passes. With this configuration, a water or food oil that travels on the cylindrical side surface of the tray table rotating shaft from the heating chamber, and drops down can be prevented from traveling on the electric motor shaft, and entering the interior of the electric motor.

Hereinafter, embodiments of the present invention will be described with reference to the drawings. The present invention is not limited by the embodiments.

First Embodiment

Figure 2:
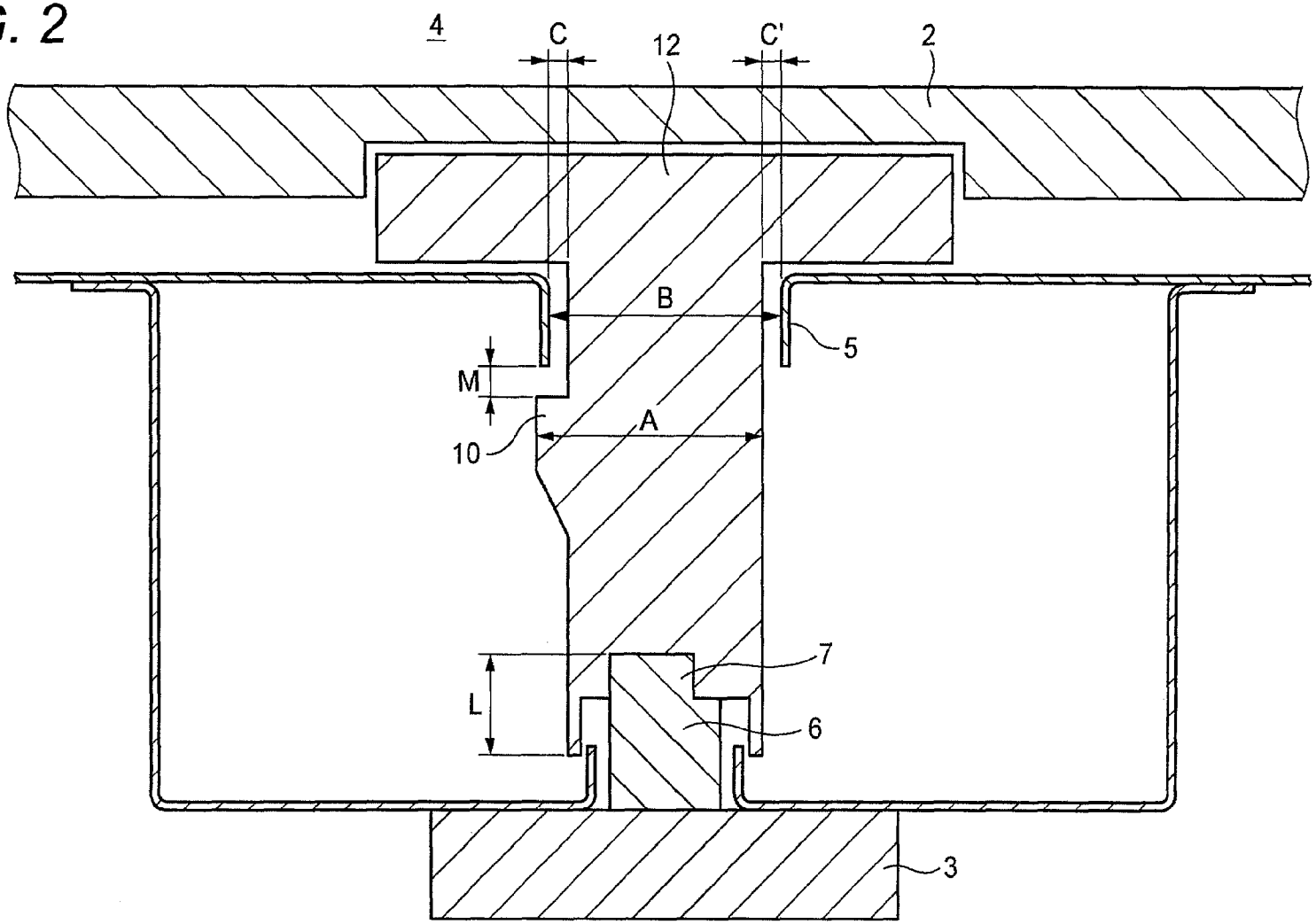
FIG. 2 is a cross-sectional view of a dimension relationship at the time of assembling the tray table rotating shaft of the high-frequency heating cooker according to the first embodiment of the present invention.

FIG. 1 is a cross-sectional view of a tray table rotating shaft structure of a high-frequency heating cooker according to a first embodiment of the present invention, and FIG. 2 is a cross-sectional view of a dimension relationship at the time of assembling the tray table rotating shaft according to the first embodiment of the present invention.

First, referring to FIG. 1, a tray table 2 which is a food placing table is arranged on a lower portion within a heating chamber 4. Also, a center hole portion is formed in the center of a bottom surface within the heating chamber 4. A tray table rotating shaft 12 made of a resin molding material is rotatably inserted through the center hole portion. The tray table rotating shaft 12 is inserted inside of a heating chamber center hole flange 5. The heating chamber center hole flange 5 serves as a bearing of the tray table rotating shaft 12.

An upper portion of the tray table rotating shaft 12 is fitted into a recessed portion formed in a bottom surface of the tray table 2, and the tray table rotating shaft 12 supports the tray table 2. A lower portion of the tray table rotating shaft 12 is formed with a recessed portion, and an electric motor shaft protrusion-recess portion 7 of an electric motor rotating shaft 6 is inserted into the recessed portion, and coupled with the tray table rotating shaft 12.

The operation and action of the tray table rotating shaft of the high-frequency heating cooker configured as described above will be described below.

First, the tray table rotating shaft 12 transmits a rotating force produced by the electric motor 3, and rotates the tray table 2 on which a food is placed. As a result, a uniform dielectric heater cooking can be realized at the time of high-frequency oscillation while the food is smoothly rotated within the heating chamber 4.

As described above, in this embodiment, a tray table rotating shaft protrusion 10 tapered or rounded on an inserting direction side is provided on a cylindrical portion of the tray table rotating shaft 12 so that the tray table rotating shaft 12 cannot be easily removed from the interior of the heating chamber 4, and when the tray table rotating shaft 12 is inserted into the center hole portion located in the center of the heating chamber 4, the tray table rotating shaft 12 may be fitted in the center hole portion in a tight fitting state. Also, when the tray table rotating shaft 12 is removed from the center hole portion, the tray table rotating shaft protrusion 10 on a side not tapered or rounded interferes with the heating chamber center hole flange 5, thereby being capable of preventing the tray table rotating shaft 12 from easily falling out.

Also, in this embodiment, a cylindrical leading end portion of the tray table rotating shaft 12 is engaged with the electric motor shaft protrusion-recess portion 7 of the electric motor rotating shaft 6, to thereby realize a structure in which the tray table rotating shaft 12 is combined with the electric motor rotating shaft 6 while the tray table rotating shaft 12 is fitted to the heating chamber 4, and no failure occurs in lateral and longitudinal directions after the electric motor 3 is assembled. The tray table rotating shaft protrusion 10 of the tray table rotating shaft 12 is abutted against the heating chamber center hole flange 5, thereby being capable of physically surely realizing fall-out prevention.

Specifically, as illustrated in FIG. 2, with a structure in which a positional relationship of the tray table rotating shaft 12, the tray table rotating shaft protrusion 10, the heating chamber center hole flange 5, a gap formed between the tray table rotating shaft 12 and the heating chamber center hole flange 5, the electric motor rotating shaft 6, and a tray table rotating shaft flange 9 fulfills the following relational expression, the tray table rotating shaft 12 cannot be removed from the heating chamber 4 after the tray table rotating shaft 12 has been fitted to the heating chamber 4.

In this example, with a structure of $M<L$ (M indicates a distance between a leading end of the heating chamber center hole flange 5 at the time of assembling related components together, and an upper end of the tray table rotating shaft protrusion 10, and L indicates a distance between a lead end portion of the electric motor rotating shaft 6 and the tray table rotating shaft flange 9), $A>B-(C+C')$, and $A-(B-(C+C'))/2>B/2$ (B indicates a diameter of the hole of the heating chamber center hole flange 5, A is a maximum diameter of a cylindrical portion of the tray table rotating shaft 12 including thickness of the tray table rotating shaft protrusion 10, and C and C' are diameters of the heating chamber center hole flange 5 and a cylindrical configuration of the tray table rotating shaft 12 including no tray table rotating shaft protrusion 10), after the tray table rotating shaft 12 has been fitted to the heating chamber 4, the tray table rotating shaft 12 cannot be removed from the interior of the heating chamber 4 so far as the electric motor 3 is not removed.

Second Embodiment

Figure 3:
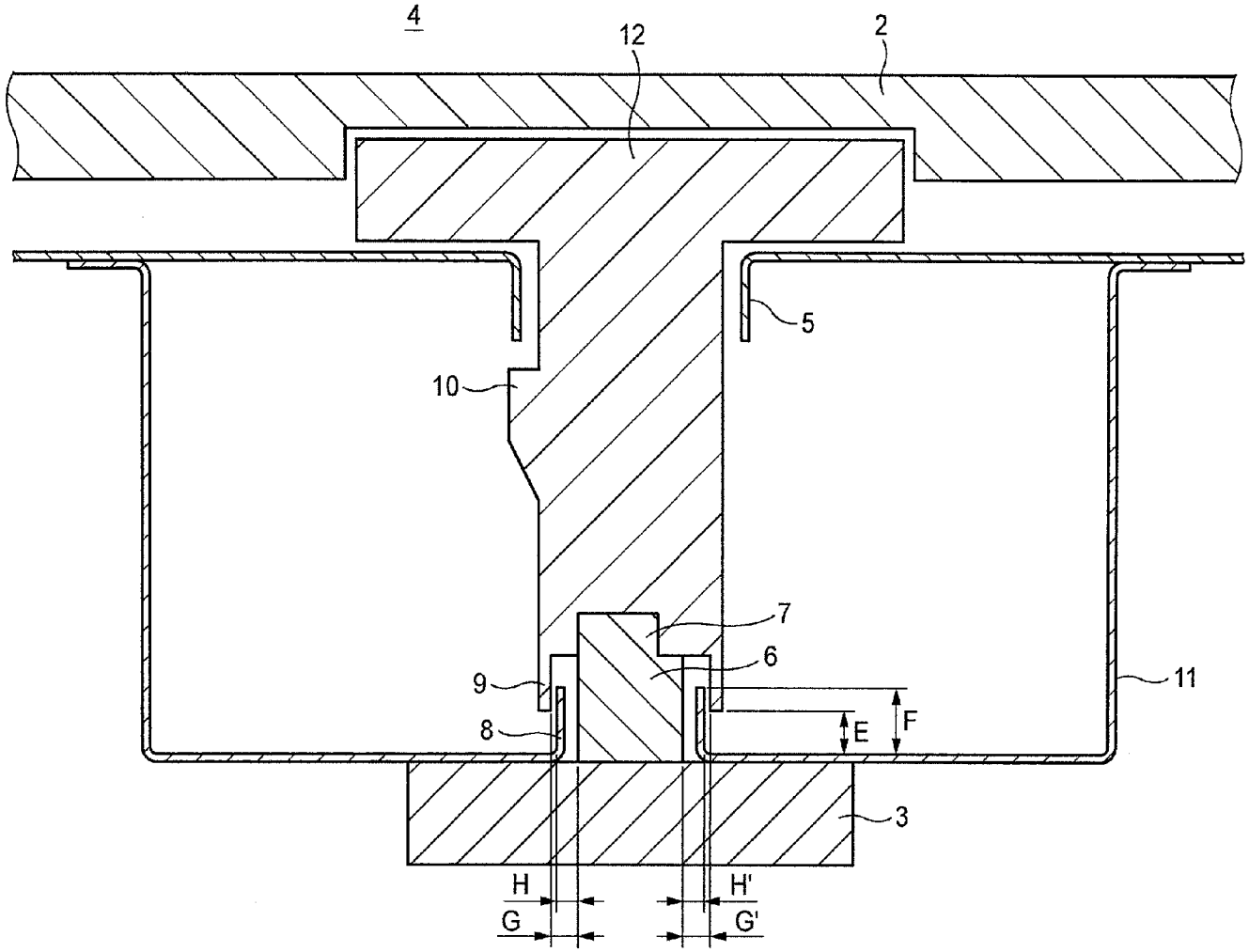
FIG. 3 is a cross-sectional view illustrating a leading end structure of a tray table rotating shaft of a high-frequency heating cooker according to a second embodiment of the present invention.
Figure 4:
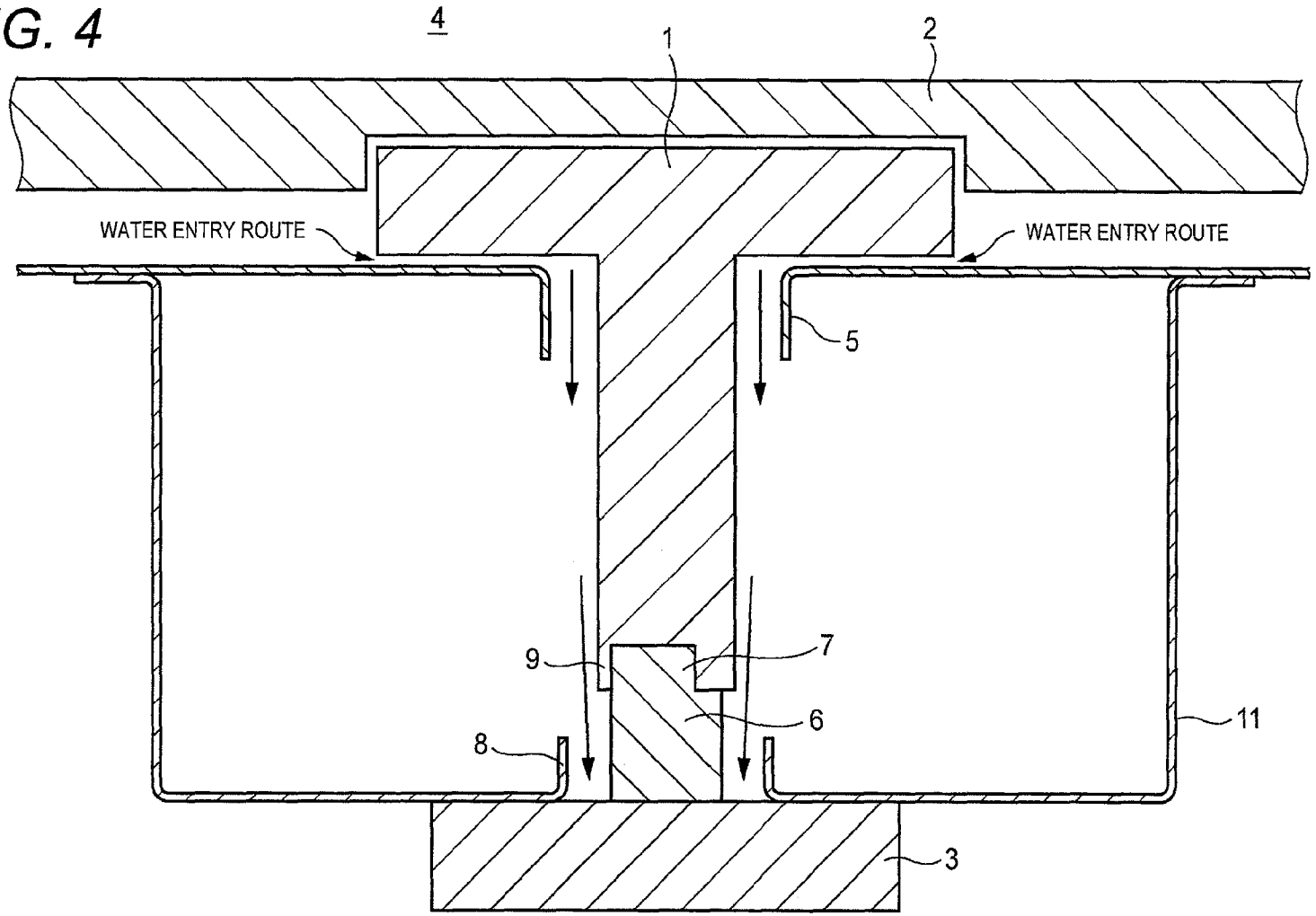
FIG. 4 is a cross-sectional view of a tray table rotating shaft structure of a related-art high-frequency heating cooker.

FIG. 3 is a cross-sectional view illustrating a leading end structure of a tray table rotating shaft according to a second embodiment of the present invention.

Referring to FIG. 3, the tray table rotating shaft flange 9 is structured to be located outside of and on a lower side of a leading end portion of an electric motor mounting plate flange 8 after the tray table rotating shaft 12 has been loaded to the electric motor 3.

Specifically, as illustrated in FIG. 3, the tray table rotating shaft flange 9 portion is lower than the leading end portion of the electric motor mounting plate flange 8, and F>E (E is a distance between the tray table rotating shaft flange 9 and an electric motor mounting plate 11, and F is a distance between a leading end of the electric motor mounting plate flange 8, and the electric motor mounting plate 11) is fulfilled, and G>H and G'>H' (G and G' indicate distances between the electric motor rotating shaft 6 and the tray table rotating shaft flange 9, and H and H' are distances between the electric motor rotating shaft 6 and an outside of the electric motor mounting plate flange 8) are fulfilled.

The operation and action of the tray table rotating shaft of the high-frequency heating cooker configured as described above will be described below.

First, droplets generated when cooking is conducted within the heating chamber 4, or water used when a user cleans the interior of the heating chamber 4 enters a center portion of the heating chamber 4 through a gap formed between the heating chamber 4 and the tray table rotating shaft 12, travels on an outer periphery of the cylindrical flange of the tray table rotating shaft 12. With the above structure satisfied, the droplets or the water runs down outside of the electric motor mounting plate flange 8, and an electric insulating performance of the electric motor 3 can be ensured. As a result, the high-frequency heating cooker high in safety can be provided.

As has been described above, in this embodiment, the positional structure relationship between the tray table rotating shaft flange 9 and the leading end of the electric motor mounting plate flange 8 is arranged so that the water that travels on the side wall of the tray table rotating shaft 12, and runs down comes out of contact with the portion of the electric motor rotating shaft 6. As a result, the electric insulating performance of the electric motor 3 can be ensured, and the high-frequency heating cooker high in safety can be provided.

The present invention is based on Japanese Patent Application No. 2011-093741 filed on Apr. 20, 2011, and content thereof is incorporated herein by reference.

INDUSTRIAL APPLICABILITY

As described above, the configuration of the tray table rotating shaft in the high-frequency heating cooker according to the present invention can be applied to a rotating force transmitting means portion of the electric motor even in an electrothermal heating cooker having a structure that rotates an object to be heated required for uniform heater cooking.

The invention claimed is:

1. A high-frequency heating cooker comprising:

a heating chamber;

a high-frequency heating unit which supplies microwaves to the heating chamber;

a tray table disposed within the heating chamber;

an electric motor including an electric motor rotating shaft; and a tray table rotating shaft which comprises a cylindrical shaft portion extending between an upper end portion that is configured to support the tray table within the heating chamber and a lower end portion that is connected to the electric motor rotating shaft to transmit a rotating force from the electric motor rotating shaft to the tray table, wherein the electric motor is fixed to the heating chamber by an electric motor mounting plate, wherein the tray table rotating shaft is made of a resin molding material and comprises a tray table rotating shaft protrusion formed on a part of a side surface of the cylindrical shaft portion to prevent the tray table rotating shaft from being removed from interior of the heating chamber by a user, and wherein the lower end portion of the tray table rotating shaft includes a downward flange and the electric motor mounting plate includes an upward flange that extends from a bottom surface of the electric motor mounting plate into an opening defined by the downward flange of the tray table rotating shaft.

2. The high-frequency heating cooker according to claim 1, wherein the heating chamber includes a center hole flange extending outwardly from a bottom surface of the heating chamber, the center hole flange defining a heating chamber center hole portion, wherein the tray table rotating shaft is inserted through the heating chamber center hole portion, wherein the tray table rotating shaft protrusion is located below the center hole flange, the tray table rotating shaft protrusion being configured to prevent the tray table rotating shaft from being removed from the interior of the heating chamber by a user, and wherein the tray table rotating shaft is coupled with the electric motor rotating shaft by a protrusion-recess configuration in order to receive the rotating force of the electric motor rotating shaft and to prevent the tray table rotating shaft from being pulled out of the heating chamber center hole portion with an angle in the heating chamber direction.

* * * * *